US006663550B2

(12) United States Patent
Frankenberger et al.

(10) Patent No.: US 6,663,550 B2
(45) Date of Patent: Dec. 16, 2003

(54) SMOOTHING DEVICE FOR FLAT PRINTING MATERIALS

(75) Inventors: Eckart Frankenberger, Darmstadt (DE); Michael Gieser, Oftersheim (DE); Peter Hachmann, Dossenheim (DE); Karl-Heinz Helmstädter, Heidelberg (DE); Christian Hieb, Neuhofe (DE); Ruben Schmitt, Heidelberg (DE); Günter Stephan, Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/944,576

(22) Filed: Aug. 31, 2001

(65) Prior Publication Data

US 2002/0060422 A1 May 23, 2002

(30) Foreign Application Priority Data

Aug. 31, 2000 (DE) ..... 100 42 891

(51) Int. Cl.[7] ..... B31B 1/80

(52) U.S. Cl. ..... 493/256; 493/192; 271/183; 271/188; 271/197; 271/194

(58) Field of Search ..... 493/186, 192, 493/256, 467; 271/194, 195, 196, 197, 188, 183; 399/406; 226/97.1, 97.3

(56) References Cited

U.S. PATENT DOCUMENTS 3,076,492 A * 2/1963 Monks ..... 72/54
3,385,490 A * 5/1968 Malmgren et al. ..... 226/7
3,429,544 A 2/1969 Williams, III
3,622,058 A * 11/1971 Vits ..... 226/7
3,779,545 A * 12/1973 Schuhmann et al. ..... 271/183
4,002,047 A * 1/1977 MacPhee et al. ..... 72/160
4,013,284 A * 3/1977 Demetre ..... 271/183
4,081,201 A * 3/1978 Hassan et al. ..... 406/88
4,119,309 A * 10/1978 Mayer et al. ..... 271/183
4,190,245 A * 2/1980 Brandes ..... 271/278
4,396,274 A * 8/1983 Kollar et al. ..... 399/164
4,909,890 A * 3/1990 Bonnyman ..... 156/494
6,098,976 A * 8/2000 Gieser et al. ..... 271/183
2001/0026043 A1 * 10/2001 Gunschera et al. ..... 271/183

FOREIGN PATENT DOCUMENTS

DE 26 49 051 5/1978
DE 38 31 753 C2 5/1989
DE 41 09 876 C2 10/1992

* cited by examiner

*Primary Examiner*—Rinaldi I. Rada
*Assistant Examiner*—Louis Tran
(74) *Attorney, Agent, or Firm*—Laurence A. Greenberg; Werner H. Stemer; Ralph E. Locher

(57) ABSTRACT

A smoothing device includes guide surface sections for a flat printing material whose leading edge is pulled in a direction of travel over the guide surface sections. The guide surface sections have openings which communicate with throttling ducts that are pressurized with compressed air during operation. The guide surface sections form a smoothing notch and have air passage openings which communicate with a flow duct. The air passage openings are configured to cause pressure conditions when there is an air throughflow during operation such that the flat printing material forms a bead projecting into the smoothing notch.

37 Claims, 9 Drawing Sheets

SMOOTHING DEVICE FOR FLAT PRINTING MATERIALS

BACKGROUND OF THE INVENTION

1. Field of the Invention

The invention relates to a smoothing device for flat printing materials. A leading edge of a printing material is pulled over guide surface sections which form a smoothing notch and have at least one air passage opening which communicates with a flow duct. During operation, the at least one air passage opening provides pressure conditions which form a bead in the printing material that projects into the smoothing notch. The invention also relates to a printing machine equipped with the smoothing device.

A smoothing device of the type described above is disclosed, for example, in German Patent No. DE 26 49 051 C2. During proper use of this smoothing device, its flow duct is connected to a vacuum generator which sucks a section of the printing material, which is momentarily located in the region of the smoothing notch, into the smoothing notch, forming a bead in the printing material. In this case, the guide surface sections, which are generally placed in a direction of travel upstream and downstream from the smoothing notch, and to a great extent also the guide surface sections forming the smoothing notch are in contact with the printing material which is drawn over them, this contact being particularly intimate in the region of the smoothing notch, because of the forces acting there on the printing material in the direction of the corresponding guide surface sections, and these forces giving rise to considerable frictional forces on the printing material, which can lead to marks being produced on the printing material.

SUMMARY OF THE INVENTION

It is accordingly an object of the invention to provide a smoothing device which overcomes the above-mentioned disadvantages of the heretofore-known smoothing devices of this general type and which can be used to smooth printing materials carefully and gently.

With the foregoing and other objects in view there is provided, in accordance with the invention, a smoothing device, including:

- guide surface sections for a flat printing material having a leading edge being pulled with positive guidance in a direction of travel over the guide surface sections;
- throttling ducts pressurized with compressed air during operation;
- the guide surface sections having openings formed therein, the openings communicating with the throttling ducts;
- a flow duct; and
- the guide surface sections forming a smoothing notch and having at least one air passage opening formed therein, the at least one air passage opening communicating with the flow duct, and the at least one air passage opening being configured to cause pressure conditions when there is an air throughflow during operation such that the flat printing material forms a bead projecting into the smoothing notch.

In other words, according to the invention, a smoothing device for flat printing materials which, with positive guidance of a printing material edge that leads in the running direction, are pulled over guide surface sections which form a smoothing notch and have at least one air passage opening which communicates with a flow duct and which, when there is throughflow during operation, gives rise to pressure conditions which, in the printing material, form a bead projecting into the smoothing notch, wherein the guide surface sections are provided with openings which communicate with throttling ducts, and wherein during operation the throttling ducts have compressed air applied to them.

A smoothing device configured in such a way develops, in addition to the suction action forming the aforementioned bead on the printing material, a supporting action which prevents any contact between the printing material and the guide surface sections which are provided with the openings communicating with the throttling ducts. This supporting action results in a manner which is advantageous insofar as it is developed at low volume flow and thus does not excite any fluttering of the printing material. Moreover, the supporting action is improved, i.e. increased, as the printing material approaches more closely to the guide surface sections provided with the openings, because of the volume flow of the throttled flow, which decreases in the process, so that between these guide surface sections and the printing material pulled over them, a pressure builds up which corresponds approximately to that at which the compressed air is fed into the throttling ducts.

According to another feature of the invention, the throttling ducts are formed by lamellae, two of the lamellae are spaced from one another by a given distance and are provided opposite one another, the two of the lamellae form contiguous flow duct sections therebetween, and the contiguous flow duct sections have a repeatedly changing flow direction.

According to a further feature of the invention, the throttling ducts are formed by at least one channel communicating with at least one inlet opening and at least one outlet opening and by a filter acting between the at least one inlet opening and the at least one outlet opening.

According to another feature of the invention, the filter is formed by a textile insert, an air-permeable bulk material filling, fibers, an air-permeable structure formed from a sintered material or an insert having an air-permeable sponge structure.

According to yet another feature of the invention, the throttling ducts are embodied by a cushion filled with platelets and having an air-permeable cushion cover.

According to a further feature of the invention, a chamber having a compressed-air connection is provided, the chamber forms one of the guide surface sections, and the throttling ducts are formed by a throttling insert adjoining the openings, and the throttling insert acts between the openings and the compressed-air connection.

According to a further feature of the invention, the throttling insert includes an air-permeable bulk material filling, a textile material, fibers, an air-permeable structure formed from a sintered material or an air-permeable sponge structure.

According to another feature of the invention, the throttling ducts are formed by a dimensionally stable throttling insert, the dimensionally stable throttling insert forms one of the surface guide sections with the openings formed therein.

According to another feature of the invention, the at least one air passage opening includes a plurality of air passage openings provided along the smoothing notch, the smoothing notch having an extent substantially transverse to the direction of travel, the air passage openings form a central group and edge groups with respect to the extent of the smoothing notch, and the central group communicates directly with the flow duct, and the edge groups communicate indirectly with the flow duct via the throttling ducts.

According to a further feature of the invention, the throttling ducts associated with the edge groups are formed by lamellae, two of the lamellae are spaced from one another by a given distance and are provided opposite one another, the two of the lamellae form contiguous flow duct sections therebetween, and the contiguous flow duct sections have a repeatedly changing flow direction.

According to a further feature of the invention, the throttling ducts associated with the edge groups are formed by at least one channel communicating with at least one inlet opening and at least one outlet opening and by a filter acting between the at least one inlet opening and the at least one outlet opening.

According to yet a further feature of the invention, the throttling ducts associated with the edge groups are formed by textile inserts or an air-permeable bulk material filling.

According to another feature of the invention, the filter includes fibers, an air-permeable structure formed from a sintered material or an insert having an air-permeable sponge structure.

According to a further feature of the invention, the throttling ducts associated with the edge groups are embodied by a cushion filled with platelets and having an air-permeable cushion cover.

According to yet a further feature of the invention, the throttling ducts are formed by throttling inserts, the air passage openings of the edge groups communicate with the flow duct via the throttling inserts.

According to another feature of the invention, the throttling inserts associated with the edge groups include an air-permeable bulk material filling, a textile material, fibers, an air-permeable structure formed from a sintered material or an air-permeable sponge structure.

According to a further feature of the invention, the throttling inserts associated with the edge groups are dimensionally stable throttling inserts.

According to another feature of the invention, further guide surface sections are provided upstream from the smoothing notch with respect to the direction of travel; the further guide surface sections form a further smoothing notch and have further air passage openings formed therein; the further air passage openings are configured to cause pressure conditions when there is an air throughflow during operation such that the flat printing material forms a further bead projecting into the further smoothing notch; further throttling ducts, which are pressurized with compressed air during operation, are provided; and a further flow duct is provided, the further air passage openings communicate with the further flow duct via the further throttling ducts.

According to a further feature of the invention, the further throttling ducts associated with the further air passage openings are formed by lamellae, two of the lamellae are spaced from one another by a given distance and are provided opposite one another, the two of the lamellae form contiguous flow duct sections therebetween, and the contiguous flow duct sections have a repeatedly changing flow direction.

According to yet a further feature of the invention, the further throttling ducts associated with the further air passage openings are formed by at least one channel communicating with at least one inlet opening and at least one outlet opening and by a filter acting between the at least one inlet opening and the at least one outlet opening.

According to another feature of the invention, the further throttling ducts associated with the further air passage openings are formed by a structure selected from the group consisting of a textile insert, an air-permeable bulk material filling, fibers, an air-permeable structure formed from a sintered material, an insert having an air-permeable sponge structure, and a cushion filled with platelets and having an air-permeable cushion cover.

According to another feature of the invention, a suction air connection is provided on the further flow duct; and the further throttling ducts are formed by a throttling insert acting between the further air passage openings and the suction air connection.

According to a further feature of the invention, the throttling insert includes an element selected from the group consisting of an air-permeable bulk material filling, a textile material, fibers, an air-permeable structure formed from a sintered material, and an air-permeable sponge structure.

According to a further feature of the invention, the throttling insert is a dimensionally stable throttling insert.

Other features which are considered as characteristic for the invention are set forth in the appended claims.

Although the invention is illustrated and described herein as embodied in a smoothing device for flat printing materials, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
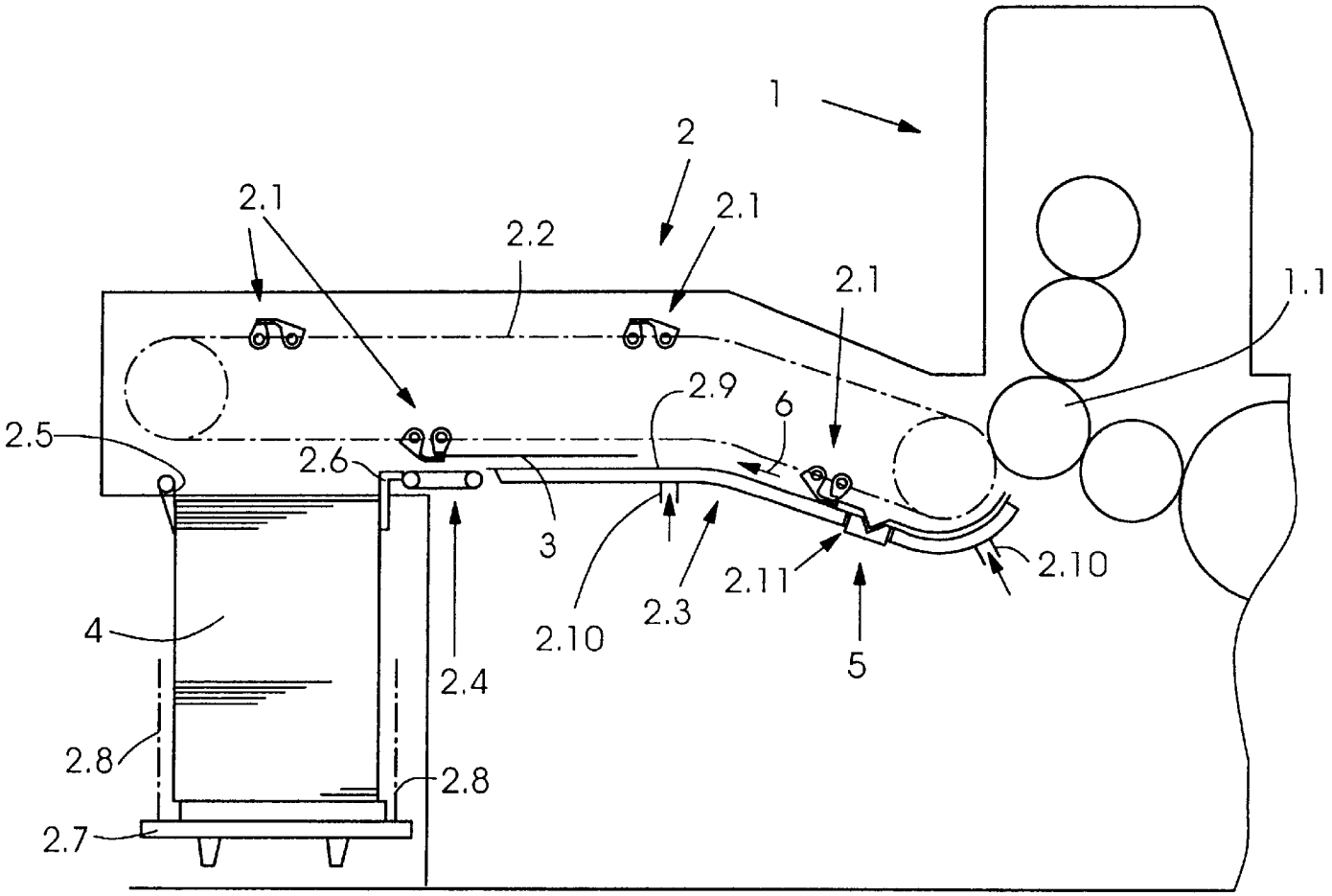
FIG. 1 is a diagrammatic side view of a segment of a sheet-processing printing machine including a delivery, wherein the sheet-processing printing machine is equipped with the smoothing device, which has, by way of example, only one smoothing notch.

Referring now to the figures of the drawings in detail and first, particularly, to FIG. 1 thereof, there is shown a smoothing device which is a constituent part of a delivery 2 which follows a last processing station 1 of a printing machine. The last processing station can be a printing unit or a finishing unit, such as a varnishing unit. In the present example, it is a printing unit operating on the offset process. The delivery 2 adjoining this includes gripper systems 2.1, which are carried by a chain conveyor 2.2 which circulates during operation and is indicated here by dash-dotted lines. During one revolution of a respective gripper system 2.1, the latter accepts a printing material in the form of a sheet 3 from the impression cylinder 1.1 carrying the sheet and transports it over a sheet guide device 2.3 to a sheet brake 2.4. The latter accepts the sheet 3 as it is released by the gripper system 2.1, brakes it to a depositing speed and in turn finally releases it, so that, at this depositing speed and while being lowered at the same time, it strikes leading edge stops 2.5 and, being aligned on the latter and on trailing edge stops 2.6 located opposite these together with preceding and/or following sheets 3, forms a stack 4, which is borne by a lifting mechanism which lowers the stack 4 to the extent to which its height grows. Of the lifting mechanism, only a platform 2.7 carrying the stack 4 and lifting chains 2.8 carrying the platform and indicated by dash-dotted lines are reproduced in FIG. 1.

On the sheet guide device 2.3, there is formed a sheet guide surface 2.9 which follows the path of the gripper systems 2.1 led over the sheet guide surface and, in order to guide sheets printed on both sides, is preferably fitted with nozzles (not shown here) to generate an air cushion between the sheet guide surface 2.9 and the sheet 3 led over the latter, the nozzles being fed by an air supply system, which is indicated in FIG. 1 through the use of the connecting piece 2.10.

In the sheet guide surface 2.9 which, in order to guide sheets printed on both sides, preferably runs substantially continuously, in order to use a smoothing device, a gap 2.11 is provided in the sheet guide device 2.3, it being possible for the gap to be closed through the use of the smoothing device.

A respective sheet 3 carried by the impression cylinder 1.1 is gripped through the use of a gripper system 2.1 in a gripper edge region, which adjoins the respective edge of the sheet 3 that leads in the running direction according to direction arrow 6, and thus passes through the delivery 2, with positive guidance of this leading edge, along the conveying path which includes the smoothing device 5, at the end of which the transfer of the sheet 3 to the sheet brake 2.4 takes place.

Figure 2:
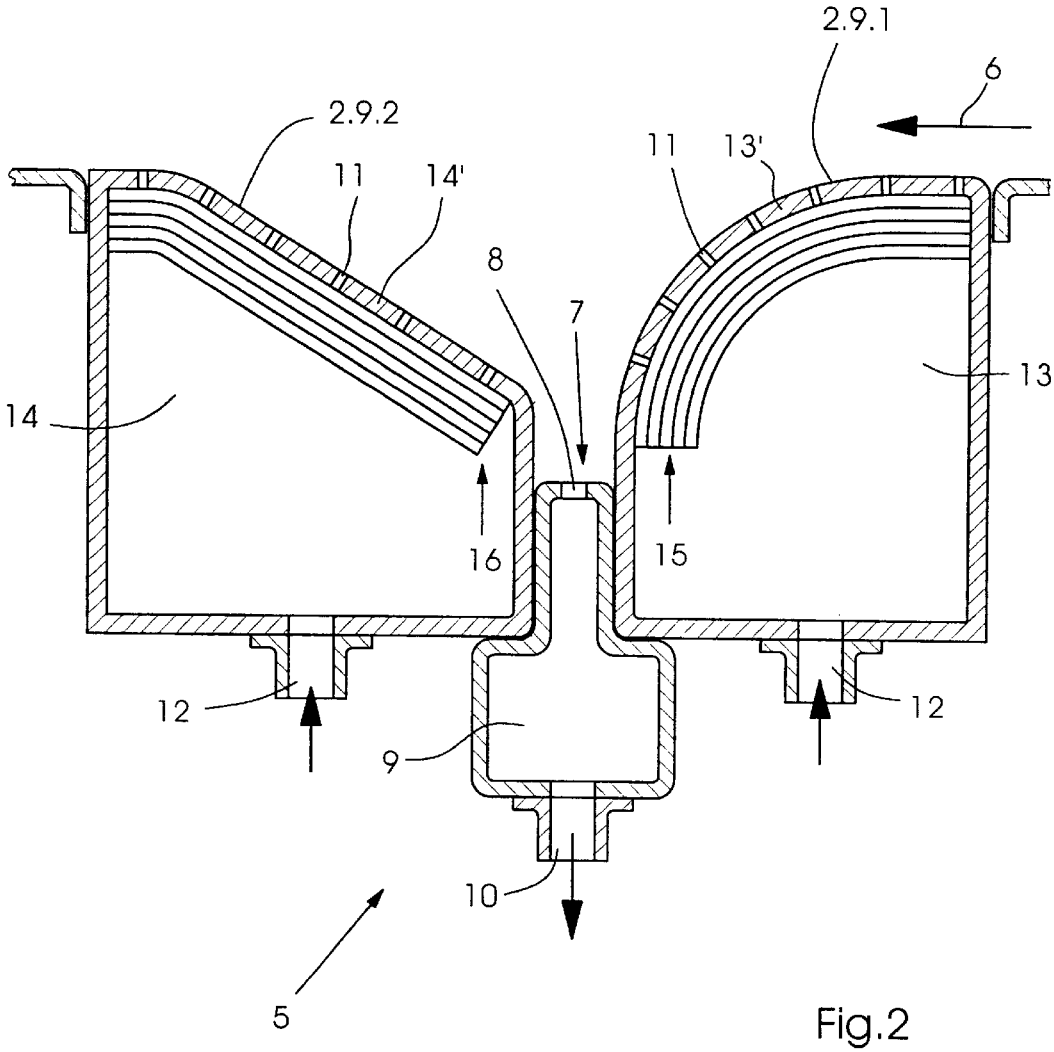
FIG. 2 is a sectional view of an exemplary embodiment of the smoothing device according to the invention, which has throttling ducts formed through the use of lamellae, wherein the section plane extends along in the direction of travel.

As can be seen from FIG. 2, the smoothing device 5 includes sheet guide sections 2.9.1 and 2.9.2, which form a smoothing notch 7, and also at least one air passage opening 8, which communicates with a flow duct 9 which is connected via a suction connection 10 to a vacuum generator (not shown). In the case of a single air passage opening 8, this is preferably provided at the center of the extent, transverse to the running direction according to direction arrow 6, of the smoothing notch 7. It is preferable for a plurality of air passage openings 8 to be provided, which follow one another along the smoothing notch 7, that is to say transversely with respect to the running direction according to direction arrow 6, and form a row of openings whose extent corresponds at least to the extent transverse to the running direction (direction of travel) of the smallest sheets processed, while the row of openings, according to a development explained later, also has a corresponding extent which is matched to that of the largest sheets processed.

The at least one air passage opening 8 through which flow passes during operation, or a row of openings formed by a plurality of the same, gives rise to pressure conditions which, on a respective sheet 3 pulled over the guide surface sections 2.9.1 and 2.9.2, form a bead projecting into the smoothing notch 7 (see FIG. 1).

The guide surface sections 2.9.1 and 2.9.2 are provided with openings 11 which communicate with throttling ducts which are explained in more detail below and, during operation, have compressed air applied to them.

In the case of the configuration reproduced in FIG. 2, chambers 13, 14 with chamber wall sections 13', 14' and each provided with a compressed air connection 12 are provided, forming a respective one of the guide surface sections 2.9.1 and 2.9.2. Within the chambers 13 and 14, a throttling insert 15 and 16 forming the throttling ducts in each case rests on a chamber wall section 13', 14' forming the openings 11, the insert in each case acting between the respective openings 11 and the respective compressed air connection 12, so that the throttling ducts formed through the use of the throttling inserts 15 and 16 have compressed air applied to them during operation, which then flows out through the openings 11, having been throttled. In order to form the throttling ducts, use is made here, by way of example, of lamellae which are combined into a respective pack, a respective one of the packs forming one of the throttling inserts 15 and 16.

Figure 3:
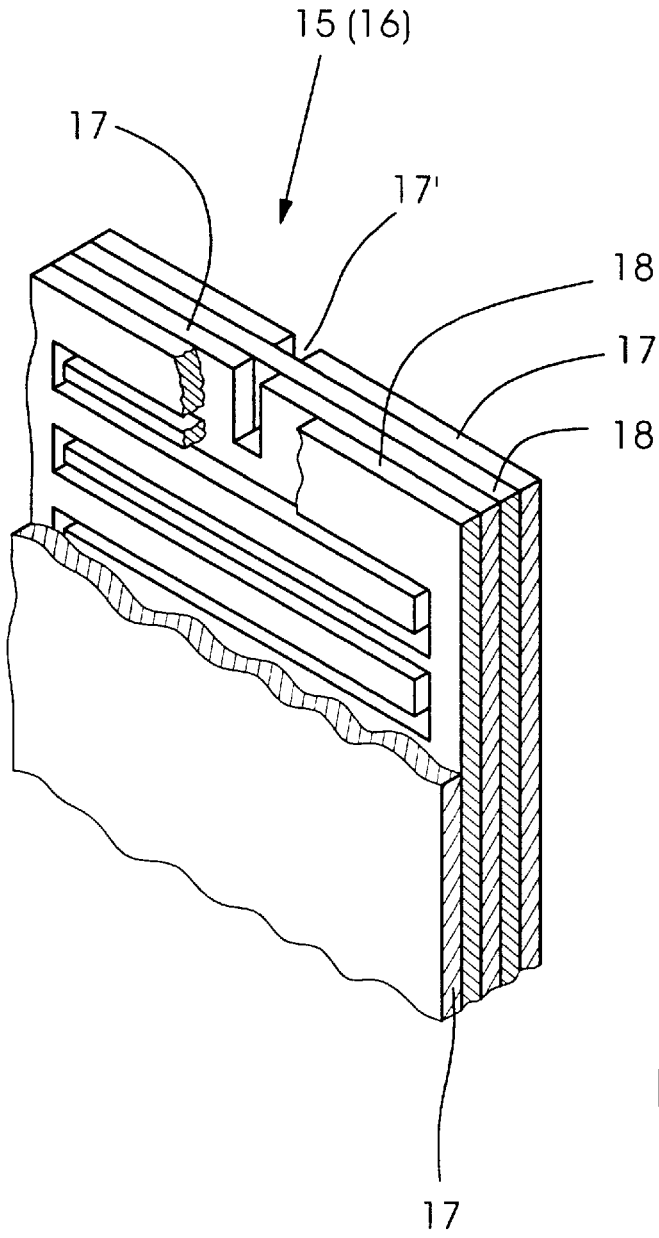
FIG. 3 is a perspective view of a detail of a pack of lamellae forming throttling ducts, wherein an exemplary configuration of the these lamellae, which form coherent flow duct sections with a repeatedly changing flow direction, is shown.

FIG. 3 shows an advantageous refinement of throttling ducts through the use of a pack of lamellae, but which preferably, for a use explained later, is provided at a different point in the smoothing device, that is to say not associated with the openings 11. This pack of lamellae includes first lamellae 17 which are located opposite one another at a distance which corresponds to the thickness of the second lamella 18 in each case provided between the first lamellae 17. The first lamellae 17 form substantially complete area joint faces, with which they rest on a second lamella 18 respectively provided between two of the first laemaellae. The respective second lamella 18 has an aperture such that, through the use of the joint faces of the respective adjacent first lamella 17, it forms coherent flow duct sections which are closed at the sides and which follow one another in a manner similar to a meander. A respective end of the meander communicates with a marginal cutout 17' in one of the respective first lamellae 17, so that the result overall is throttling ducts in the form of flow duct sections having a repeatedly changing flow direction. The pack of lamellae composed of the first and second lamellae 17 and 18 has flow through it during operation starting from first ends of its lamellae and going in the direction of its opposite ends. The number and geometry of the lamellae 17 and 18 are matched to the given requirements.

Figure 4:
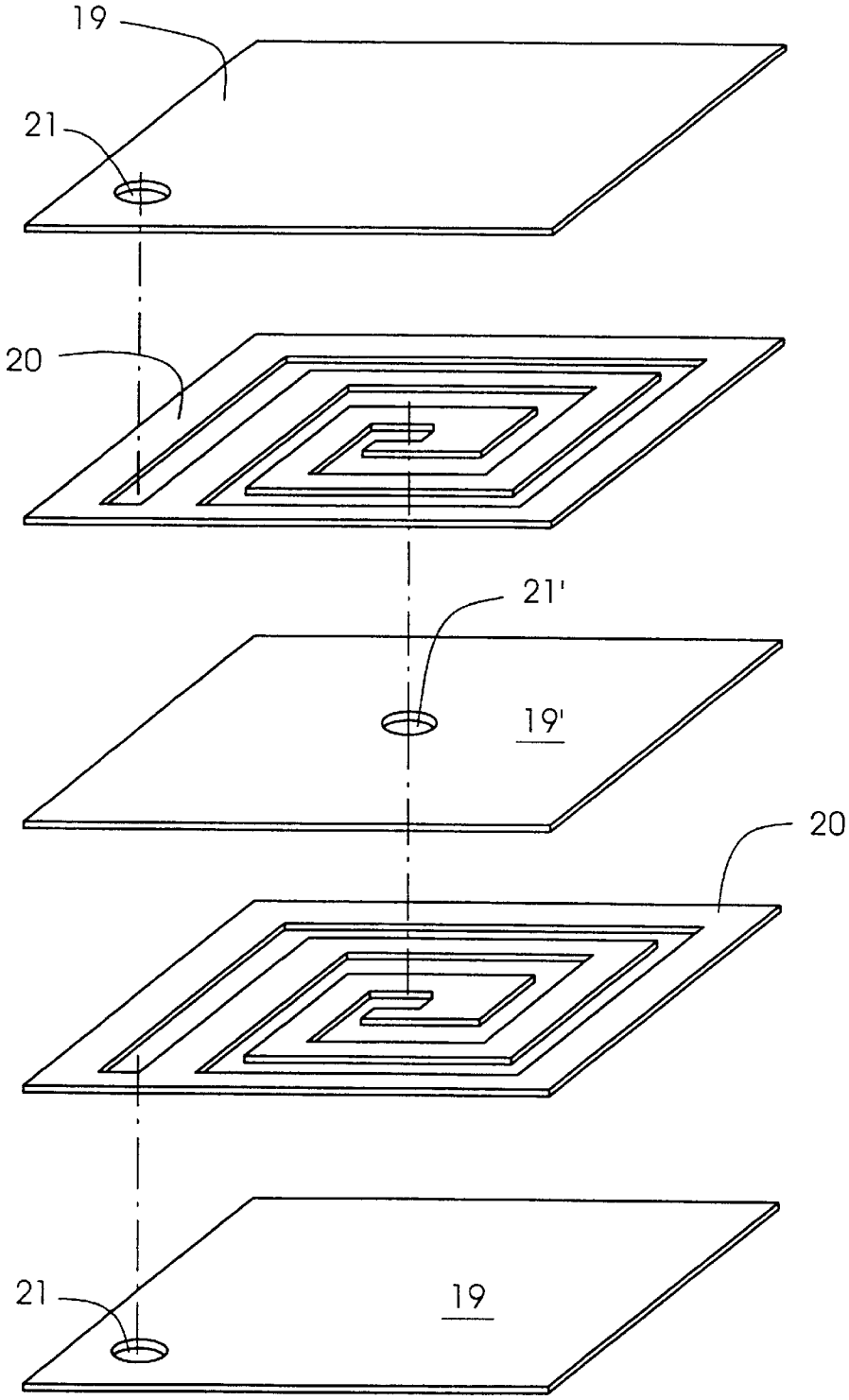
FIG. 4 is an exploded view of a pack of lamellae according to a further exemplary embodiment of the lamellae for forming coherent flow duct sections with a repeatedly changing flow direction.

Similar matching also applies to the detail, reproduced in an exploded illustration in FIG. 4, of a pack of lamellae, which has an alternative configuration of flow duct sections with repeatedly changing flow direction and is used in a preferred configuration to form the throttling inserts 15, 16 according to FIG. 2. In this case, again limiting lamellae 19 and 19' and, together with these, coherent flow duct sections alternate with intermediate lamellae 20 forming a repeatedly changing flow direction. The intermediate lamellae 20 are here formed (e.g. cut out) in such a way that the result is coherent gaps provided in the manner of a spiral with rectilinear sections in the present example. Provided in the limiting lamellae 19 and 19' are cutouts 21 and 21', which communicate with an outer and inner end, respectively, of the "spiral".

The outer ends of the "spirals" in the present example communicate with recesses 21 which are provided in alignment—here in the form of holes—so that during operation the pack of lamellae is flowed through in the direction of its layering. Although the cutouts in the lamellae 19, 19', 20 are represented as flat here, in order to adapt them to a respective chamber wall section 13' 14', they are fitted closely against the latter.

With slight modifications of the configuration according to FIG. 4, it is also possible to achieve a flow direction present in FIG. 3 for use at a different point in the smoothing device, which will be discussed further in the further course of the text. These changes include an alternately oppositely directed configuration of the "spiral" and marginal cutouts communicating with a respective outer end of said spiral in the limiting lamellae 19, instead of the cutouts 21 provided according to FIG. 4.

In order to achieve an adequate throttling action, the flow duct sections in the configurations according to FIGS. 3 and 4 have a relatively small cross section with a relatively long total length of a "meander" or a "spiral", and the changes in the flow direction of the same are as abrupt as possible.

In a further configuration, throttling ducts are formed from at least one channel communicating with inlet and outlet openings and a filter which acts between the inlet and outlet openings.

Figure 5:
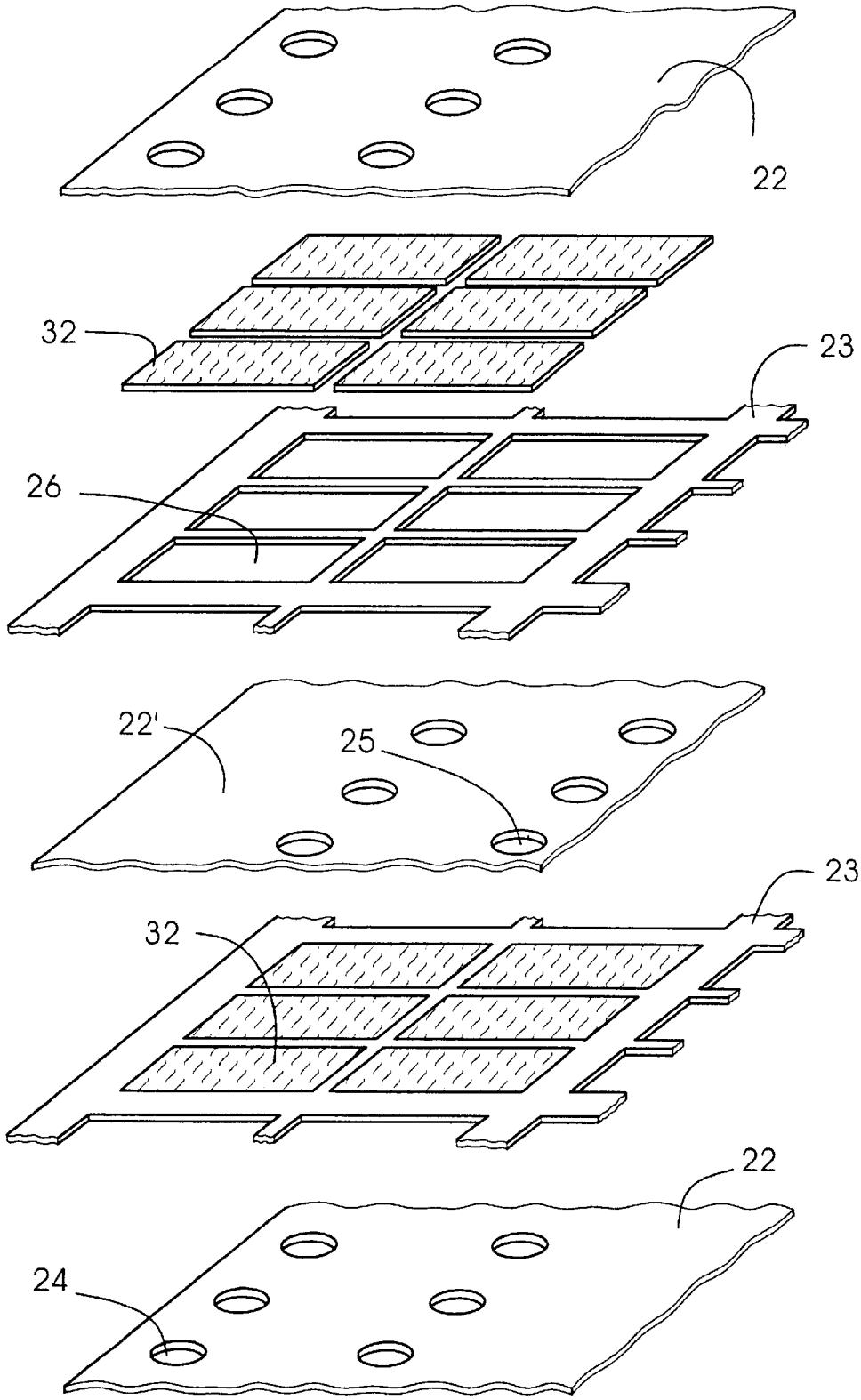
FIG. 5 is an exploded view of an exemplary embodiment in which a throttling duct is formed, at least one channel communicating with inlet and outlet openings and a filter acting between the openings.

FIG. 5 shows an advantageous embodiment of such a configuration, in the form of an exploded illustration of a detail from a pack of lamellae which, in turn, is composed of limiting lamellae 22 and 22' and intermediate lamellae 25 inserted between these. In this case, the limiting lamellae 22 and 22' have the inlet and outlet openings 24 and 25. These communicate with channels in the form of apertures 26 which are provided in the intermediate lamellae 23 and are covered by the joint faces of the limiting lamellae 22 and 221, and in the present example are elongate.

A filter that acts between the inlet and outlet openings 25 and 24 is represented in the present example by an air-permeable insert 32 which fills the aperture 26.

It goes without saying that the configuration according to FIG. 5 already forms throttling channels without the filters provided there.

In the geometry provided as an example of the limiting lamellae 22 and 22' (inlet and outlet openings 24 and 25 in the form of holes), a corresponding pack of lamellae can be flowed through in the direction of its layering, so that given appropriate geometry and close fitting to a chamber wall section 131, 14', the outflow openings of the upper limiting laemella 22 in FIG. 5 communicate directly with the openings 11 in these chamber wall sections 13' 14'.

Figure 6:
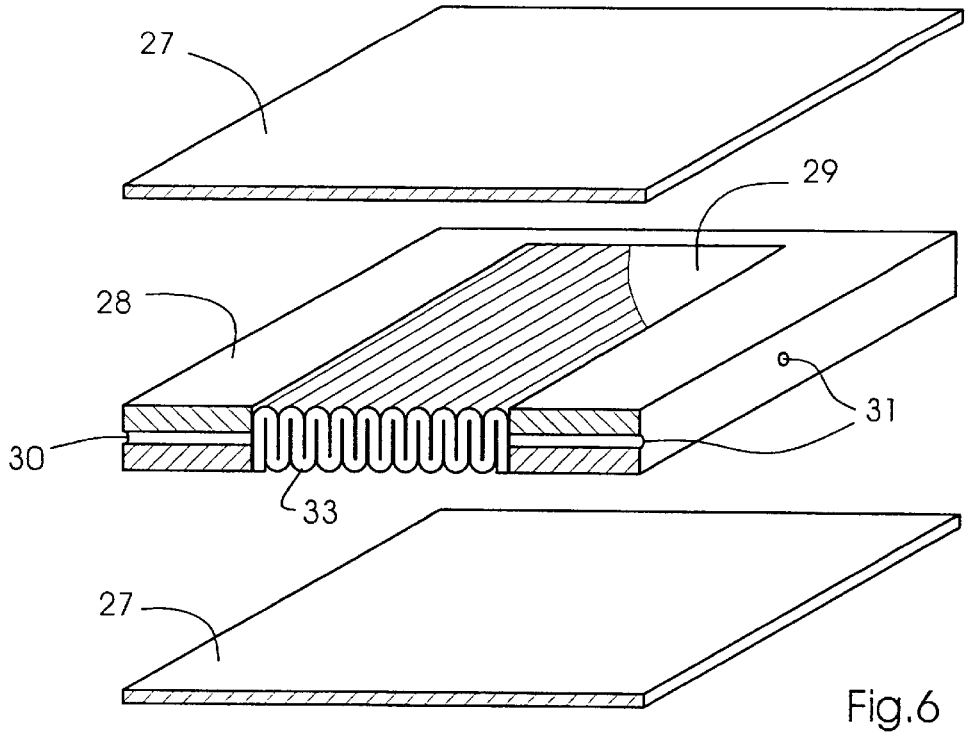
FIG. 6 is an exploded view of an exemplary embodiment with a textile insert used to form the aforementioned filter.

As can be seen from FIG. 6, the configurations within the scope of the invention and using packed lamellae are not restricted to those presented so far. In a configuration according to FIG. 6, although limiting lamellae 27 and intermediate lamellae 28 inserted between these are again provided, the intermediate lamellae 28 have an aperture 29 which, together with the limiting lamellae 27, forms a duct and, in terms of its geometry, differs from the configurations according to FIGS. 3 to 5 and communicates with a plurality of inlet and outlet openings 30 and 31, which here are, moreover, incorporated into mutually opposite ends of the intermediate lamellae 28.

A filter which has already been mentioned with reference to FIG. 5, and in the case of the configuration of FIG. 6, acts between the inlet and outlet openings 30 and 31 communicating with the aforesaid duct, is constituted here, as an example, as a textile insert 33 in the form of a section of a textile web which extends in the aperture 29 in a zigzag fold between the inlet and outlet openings.

As shown by way of example in FIGS. 7*a* to 7*e*, the aforesaid ducts communicating with inlet and outlet openings are implemented in an alternative configuration in the form of holes 34 which, in the exemplary embodiment shown, are provided in blocks which are built up from a plurality of layers, form throttling inserts and are reproduced here in fragmentary fashion, and these holes 34 penetrating the layers.

Figures 7A, 7B, 7C, 7D, 7E:
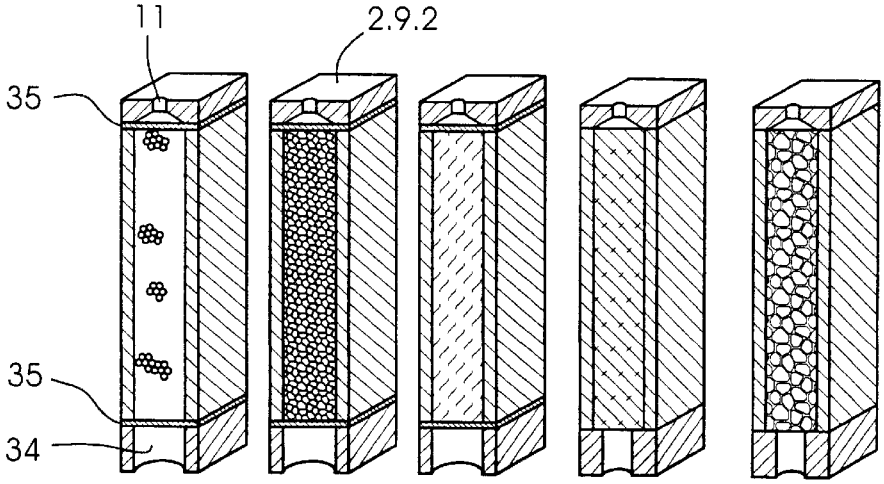
FIG. 7*a* is a sectional view of an alternative configuration of the aforementioned filter using an air-permeable spherical bulk material filling.
FIG. 7*b* is a sectional view of an alternative configuration of the aforementioned filter using an air-permeable granular bulk material filling.
FIG. 7*c* is a sectional view of an alternative configuration of the aforementioned filter using fibers.
FIG. 7*d* is a sectional view of an alternative configuration of the aforementioned filter using an air-permeable sponge structure.
FIG. 7*e* is a sectional view of an alternative configuration of the aforementioned filter using an air-permeable structure of sintered material.

Using the example of FIGS. 7*a* to 7*e*, in addition, alternative configurations of the aforementioned filter are indicated in conjunction with ducts alternatively formed as holes 34, the holes 34 forming the aforementioned inlet and outlet openings, between which the filter acts. In FIGS. 7*a* and 7*b* a filter is formed by using an air-permeable bulk material filling introduced into the hole 34, substantially spherical bulk material (FIG. 7*a*), granular bulk material (FIG. 7*b*), fibers (FIG. 7*c*), an air-permeable sponge structure (FIG. 7*d*), and an air-permeable structure of sintered material (FIG. 7*e*) may be used.

For the case in which bulk materials or fibers are used, the holes 34 accommodating these materials are provided in a respective end region of the same with an air-permeable closure which, in the example shown, is formed by intermediate layers 35, for example textile intermediate layers.

For the case in which the aforementioned sponge structure or the aforementioned sintered material is used, the intermediate layers 35 and the top layer in FIG. 7 can be dispensed with, given appropriate graduation of the end sections of the holes 34 forming the aforementioned inlet and outlet openings.

Figure 8:
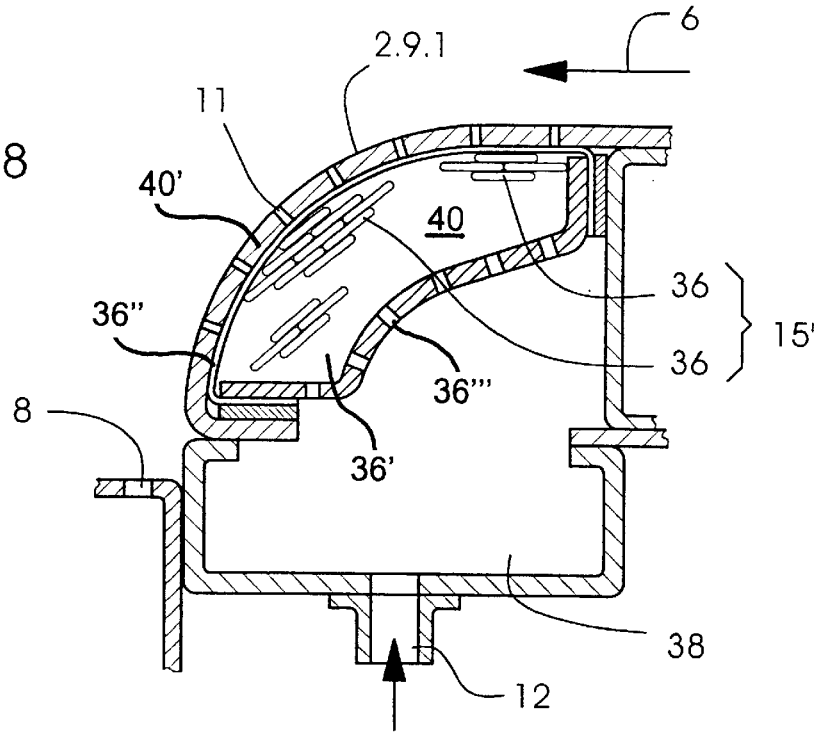
FIG. 8 is a sectional view corresponding to FIG. 2 of an alternative configuration of throttling ducts using a bulk material.

In the case of the further alternative, illustrated in FIG. 8 using the example of a chamber 40 corresponding to the chamber 13 in FIG. 2 and forming the guide surface section 2.9.1, to form a throttle insert 15', a cushion 36' filled with a bulk material—here with platelets 36—is provided, and is inserted into the chamber 40, being fitted closely against the chamber wall section 40' forming the openings 11. A compressed-air connection 12 supplies compressed air into a chamber 38, wherein the air is blown through air inlet openings 36''' into the cushion 36'.

A cushion cover 36" enclosing the platelets 36 is provided with air inlet openings 36'" on the side of the cushion 36' facing away from the chamber wall section 40' and, at least in the portion which is closely fitted to the chamber wall section 40', is flexible and air-permeable.

Instead of filling the cushion 36' with a bulk material, in alternative configurations, a textile material, an air-permeable structure of sintered material, an air permeable sponge structure or a fibrous structure is provided.

Figure 9:
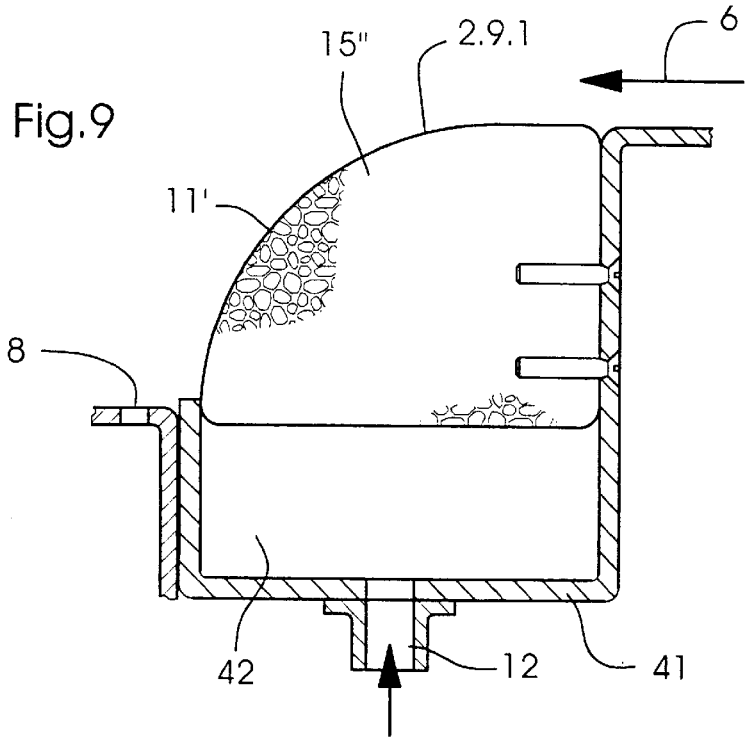
FIG. 9 is a sectional view corresponding to FIG. 2 of an alternative configuration of throttling ducts using a dimensionally stable throttling insert, which forms the guide surface sections and its openings, which, in the example shown, is formed through the use of an air-permeable structure of a sintered material.

According to a development illustrated in FIG. 9, a dimensionally stable throttling insert 15" forming the throttling ducts is provided of a type which is special inasmuch as the insert forms one of the guide surface section 2.9.1 and 2.9.2 provided to form the smoothing notch 7, and openings 11' provided therein. As indicated in FIG. 9, the throttling insert 15" includes an air-permeable structure of sintered material and it forms a closure for a housing 41 which is provided with a compressed-air connection 12 and which, together with the throttling insert 15", forms a chamber 42.

In connection with FIG. 10, inter alia the use of a throttling insert at a different location than that associated with the openings 11 will be discussed, in addition to the use already mentioned several times.

Figure 10:
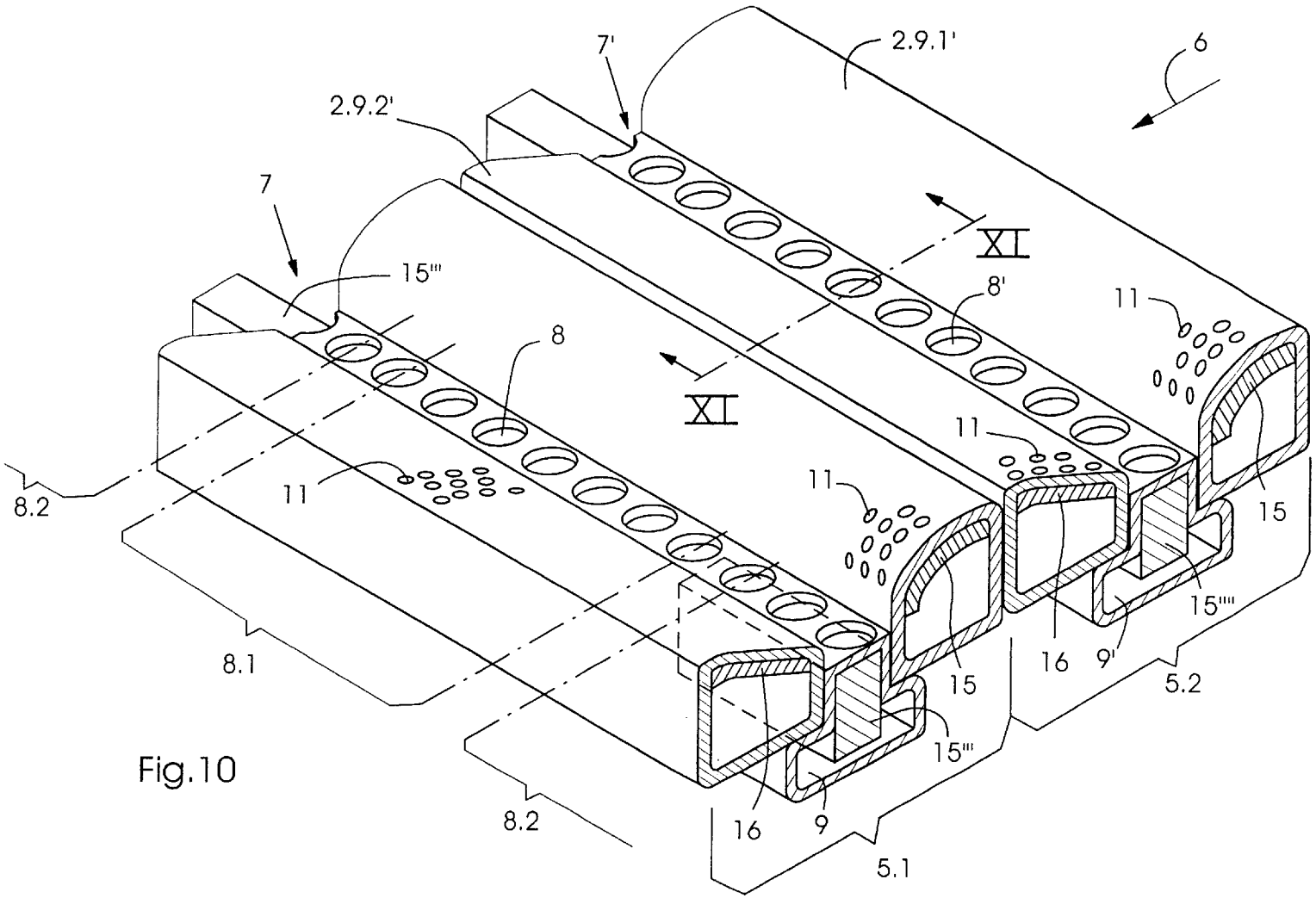
FIG. 10 is a perspective view of an exemplary embodiment of a smoothing device according to the invention having two smoothing notches following each other in the running direction of the printing material.

In the development illustrated in FIG. 10, in order to produce the bead which can be seen from FIG. 1 in a first smoothing section 5.1 substantially corresponding to the configuration of FIG. 2, a plurality of air passage openings 8 is provided along the smoothing notch 7, the air passage openings 8 form a central group 8.1 with respect to the extent of the smoothing notch 7 transverse to the running direction according to direction arrow 6, and a respective edge group 8.2, the central group 8.1 communicating directly with the flow duct 9, while the edge groups 8.2 communicate indirectly with the flow duct 9 via throttling ducts.

In this case, the central group 8.1 preferably extends along the smoothing notch 7 to such an extent that the air passage openings 8 of this group lie within the extent, present in the same direction, of the smallest format of the sheets processed.

With the smoothing device constructed in such a way, not only is gentle smoothing of the sheets 3 possible, but also optimized processing both of sheets with the smallest format and also of those with the largest format that can be processed. When processing the largest format, the edge regions of the sheets exceeding the smallest format will be smoothed adequately, and when processing the smallest format, excessive unwanted air flow is prevented through the use of the throttling ducts, so that the aforementioned pressure conditions required to form the bead are not excessively impaired.

In order to form the throttling ducts, recourse is made in particular to the alternatives already presented in connection with FIGS. 3, 6, 7*a* to 7*e*, 8 and 9. However, a configuration corresponding to FIG. 4 can also be used, in particular if the modifications mentioned in connection with FIG. 4 are provided.

In the case of the configuration according to FIG. 10, as an example, the dimensionally stable throttling inserts 15'" forming the throttling ducts are provided, their throttling ducts communicating firstly with the edge groups 8.2 of the air passage openings 8 in the smoothing notch 7 and secondly with the flow duct 9 corresponding to the configuration according to FIG. 2, which is likewise provided with a suction connection 10 (not illustrated in FIG. 10).

As can further be seen from FIG. 10, according to an advantageous development of the invention, the first smoothing section 5.1 is adjoined by a second smoothing section 5.2 which, with regard to the running direction according to direction arrow 6, is placed upstream with respect to the first and, as can be seen, corresponds to the first smoothing section 5.1 and again has guide surface sections 2.9.1' and 2.9.2' and air passage openings 8', the latter giving rise, when flowed through during operation, to pressure conditions which, on a printing material, form a bead projecting into the smoothing notch 7' provided in the second smoothing section 5.2.

Figure 11:
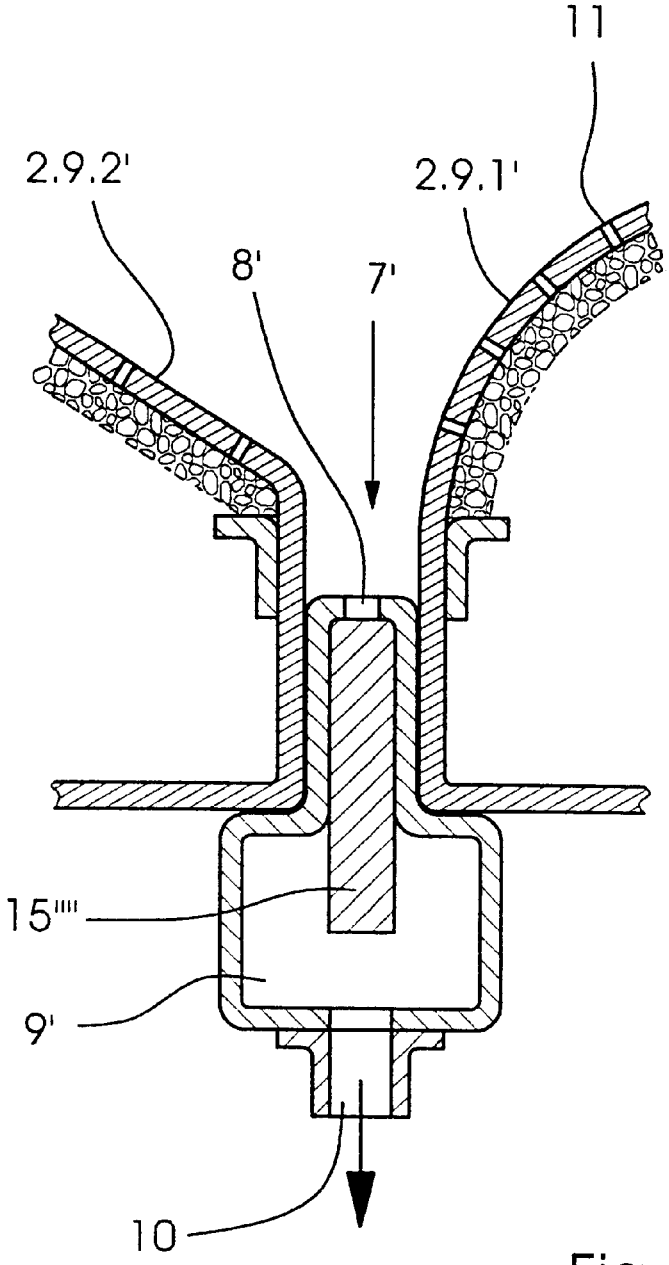
FIG. 11 is a sectional view along section line XI—XI in FIG. 10.

In the configuration shown as an example in FIG. 10, the aforementioned throttling ducts are formed by a dimensionally stable throttling insert 15"" which acts between the further air passage openings 8' and a suction connection 10 provided on the flow duct 9' (see FIG. 11).

The second smoothing section 5.2 which has been presented so far develops the aforementioned pressure relationships for forming the bead, projecting into the smoothing notch 7', in the printing material only after a corresponding bead has been formed by the downstream smoothing section 5.1, because of the throttled flow through the air passage openings 8'. Otherwise, the second smoothing section 5.2 is constructed in a similar way to the first smoothing section 5.1 with respect to a non-contact smoothing operation, that is to say the guide surface sections 2.9.1' and 2.9.2' provided to form the second smoothing notch 7' are provided with openings 11 and 11' in the event of these guide surface sections being formed through the use of a structure of sintered materials, for example, from which openings throttled compressed air flows out in the direction of the printing material and prevents its contact with the aforementioned guide surface sections.

We claim:

1. A smoothing device, comprising:

guide surface sections for a flat printing material having a leading edge being pulled with positive guidance in a direction of travel over said guide surface sections;

throttling ducts pressurized with compressed air during operation, said throttling ducts being formed by lamellae, two of said lamellae being spaced from one another by a given distance and being provided opposite one another, said two of said lamellae forming contiguous flow duct sections therebetween, and said contiguous flow duct sections having a repeatedly changing flow direction;

said guide surface sections having openings formed therein, said throttling ducts discharging into said openings formed in said guide surface sections;

a flow duct; and said guide surface sections forming a smoothing notch and having at least one air passage opening formed therein, said at least one air passage opening communicating with said flow duct, and said at least one air passage opening being configured to cause pressure conditions when there is an air throughflow during operation such that the flat printing material forms a bead projecting into said smoothing notch.

2. A smoothing device, comprising:

guide surface sections for a flat printing material having a leading edge being pulled with positive guidance in a direction of travel over said guide surface sections;

throttling ducts pressurized with compressed air during operation, said throttling ducts being formed by at least one channel communicating with at least one inlet opening and at least one outlet opening and by a filter acting between said at least one inlet opening and said at least one outlet opening;

said guide surface sections having openings formed therein, said throttling ducts discharging into said openings formed in said guide surface sections;

a flow duct; and said guide surface sections forming a smoothing notch and having at least one air passage opening formed therein, said at least one air passage opening communicating with said flow duct, and said at least one air passage opening being configured to cause pressure conditions upon presence of an air throughflow during operation causing the flat printing material to form a bead projecting into said smoothing notch.

3. The smoothing device according to claim 2, wherein said filter is formed by a textile insert.

4. The smoothing device according to claim 2, wherein said filter is formed from an air-permeable bulk material filling.

5. The smoothing device according to claim 2, wherein said filter includes fibers.

6. The smoothing device according to claim 2, wherein said filter includes an air-permeable structure formed from a sintered material.

7. The smoothing device according to claim 2, wherein said filter is formed by an insert having an air-permeable sponge structure.

8. A smoothing device, comprising:

guide surface sections for a flat printing material having a leading edge being pulled with positive guidance in a direction of travel over said guide surface sections, said guide surface sections having openings formed therein;

a chamber having a compressed-air connection, said chamber forming one of said guide surface sections;

throttling ducts pressurized with compressed air during operation, said throttling ducts being formed by a throttling insert adjoining said openings of said guide surface sections, said throttling insert acting between said openings and said compressed-air connection, said throttling ducts discharging into said openings formed in said guide surface sections;

a flow duct; and said guide surface sections forming a smoothing notch and having at least one air passage opening formed therein, said at least one air passage opening communicating with said flow duct, and said at least one air passage opening being configured to cause pressure conditions upon presence of an air throughflow during operation causing the flat printing material to form a bead prolecting into said smoothing notch.

9. The smoothing device according to claim 8, wherein said throttling insert includes an air-permeable bulk material filling.

10. The smoothing device according to claim 8, wherein said throttling insert includes a textile material.

11. The smoothing device according to claim 8, wherein said throttling insert includes fibers.

12. The smoothing device according to claim 8, wherein said throttling insert includes an air-permeable structure formed from a sintered material.

13. The smoothing device according to claim 8, wherein said throttling insert includes an air-permeable sponge structure.

14. The smoothing device according to claim 8, wherein said throttling insert is a dimensionally stable throttling insert, said dimensionally stable throttling insert forms one of said surface guide sections with said openings formed therein.

15. A smoothing device, comprising:

guide surface sections for a flat printing material having a leading edge being pulled with positive guidance in a direction of travel over said guide surface sections;

throttling ducts pressurized with compressed air during operation;

said guide surface sections having openings formed therein, said throttling ducts discharging into said openings formed in said guide surface sections;

a flow duct;

said guide surface sections forming a smoothing notch and having a plurality of air passage openings provided along said smoothing notch, said air passage openings communicating with said flow duct, and said air passage openings being configured to cause pressure conditions upon presence of an air throughflow during operation causing the flat printing material to form a bead projecting into said smoothing notch;

said smoothing notch having an extent substantially transverse to the direction of travel, said air passage openings form a central group and edge groups with respect to said extent of said smoothing notch; and said central group communicating directly with said flow duct, and said edge groups communicating indirectly with said flow duct via said throttling ducts.

16. The smoothing device according to claim 10, wherein said throttling ducts associated with said edge groups are formed by lamellae, two of said lamellae are spaced from one another by a given distance and are provided opposite one another, said two of said lamellae form contiguous flow duct sections therebetween, and said contiguous flow duct sections have a repeatedly changing flow direction.

17. The smoothing device according to claim 15, wherein said throttling ducts associated with said edge groups are formed by at least one channel communicating with at least one inlet opening and at least one outlet opening and by a filter acting between said at least one inlet opening and said at least one outlet opening.

18. The smoothing device according to claim 15, wherein said throttling ducts associated with said edge groups are formed by textile inserts.

19. The smoothing device according to claim 15, wherein said throttling ducts associated with said edge groups are formed from an air-permeable bulk material filling.

20. The smoothing device according to claim 17, wherein said filter includes fibers.

21. The smoothing device according to claim 17, wherein said filter includes an air-permeable structure formed from a sintered material.

22. The smoothing device according to claim 17, wherein said filter is formed by an insert having an air-permeable sponge structure.

23. The smoothing device according to claim 15, wherein said throttling ducts associated with said edge groups are embodied by a cushion filled with platelets and having an air-permeable cushion cover.

24. The smoothing device according to claim 15, wherein said throttling ducts are formed by throttling inserts, said air passage openings of said edge groups communicate with said flow duct via said throttling inserts.

25. The smoothing device according to claim 24, wherein said throttling inserts associated with said edge groups include an air-permeable bulk material filling.

26. The smoothing device according to claim 24, wherein said throttling inserts associated with said edge groups include a textile material.

27. The smoothing device according to claim 24, wherein said throttling inserts associated with said edge groups include fibers.

28. The smoothing device according to claim 24, wherein said throttling inserts associated with said edge groups include an air-permeable structure formed from a sintered material.

29. The smoothing device according to claim 24, wherein said throttling inserts associated with said edge groups include an air-permeable sponge structure.

30. The smoothing device according to claim 24, wherein said throttling inserts associated with said edge groups are dimensionally stable throttling inserts.

31. A smoothing device, comprising:

guide surface sections for a flat printing material having a leading edge being pulled with positive guidance in a direction of travel over said guide surface sections, said guide surface sections forming a smoothing notch and having air passage openings formed therein;

said air passage openings being configured to cause pressure conditions upon presence of an air through-flow during operation causing the flat printing material to form a bead projecting into said smoothing notch;

throttling ducts pressurized with compressed air during operation;

said guide surface sections having openings formed therein, said throttling ducts discharging into said openings formed in said guide surface sections;

a flow duct, said air passage openings communicating with said flow duct;

further guide surface sections upstream from said smoothing notch with respect to the direction of travel, said further guide surface sections forming a further smoothing notch and having further air passage openings formed therein;

said further air passage openings being configured to cause pressure conditions when there is an air through-flow during operation such that the flat printing material forms a further bead projecting into said further smoothing notch;

further throttling ducts pressurized with compressed air during operation; and a further flow duct, said further air passage openings communicating with said further flow duct via said further throttling ducts.

32. The smoothing device according to claim 31, wherein said further throttling ducts associated with said further air passage openings are formed by lamellae, two of said lamellae are spaced from one another by a given distance and are provided opposite one another, said two of said lamellae form contiguous flow duct sections therebetween, and said contiguous flow duct sections have a repeatedly changing flow direction.

33. The smoothing device according to claim 31, wherein said further throttling ducts associated with said further air passage openings are formed by at least one channel communicating with at least one inlet opening and at least one outlet opening and by a filter acting between said at least one inlet opening and said at least one outlet opening.

34. The smoothing device according to claim 31, wherein said further throttling ducts associated with said further air passage openings are formed by a structure selected from the group consisting of a textile insert, an air-permeable bulk material filling, fibers, an air-permeable structure formed from a sintered material, an insert having an air-permeable sponge structure, and a cushion filled with platelets and having an air-permeable cushion cover.

35. The smoothing device according to claim 31, including:

a suction air connection provided on said further flow duct; and said further throttling ducts being formed by a throttling insert acting between said further air passage openings and said suction air connection.

36. The smoothing device according to claim 35, wherein said throttling insert includes an element selected from the group consisting of an air-permeable bulk material filling, a textile material, fibers, an air-permeable structure formed from a sintered material, and an air-permeable sponge structure.

37. The smoothing device according to claim 35, wherein said throttling insert is a dimensionally stable throttling insert.

* * * * *